US009107456B2

(12) United States Patent
Mehio

(10) Patent No.: US 9,107,456 B2
(45) Date of Patent: Aug. 18, 2015

(54) HOOKAH HOSE, HOOKAH SYSTEM

(75) Inventor: Nizar Mehio, Tallet El Khayet (LB)

(73) Assignee: Mya Saray, LLC, Sterling, VA (US)

( * ) Notice: Subject to any disclaimer, the term of this patent is extended or adjusted under 35 U.S.C. 154(b) by 1157 days.

(21) Appl. No.: 12/944,063

(22) Filed: Nov. 11, 2010

(65) Prior Publication Data

US 2012/0118305 A1 May 17, 2012

(51) Int. Cl.

| | |
|---|---|
| ***A24B 5/02*** | (2006.01) |
| ***A24B 5/08*** | (2006.01) |
| ***A24F 1/30*** | (2006.01) |

(52) U.S. Cl.

CPC ..... *A24F 1/30* (2013.01)

(58) Field of Classification Search

None

See application file for complete search history.

(56) References Cited

U.S. PATENT DOCUMENTS

| | | | | |
|---|---|---|---|---|
| 3,506,018 | A * | 4/1970 | Petrino | 131/194 |
| 4,164,950 | A * | 8/1979 | Bechtold | 131/194 |
| 6,067,993 | A * | 5/2000 | Mahoney, III | 131/173 |
| 2006/0107964 | A1 * | 5/2006 | Ohanesian | 131/173 |
| 2006/0272657 | A1 * | 12/2006 | Mehio | 131/173 |

* cited by examiner

*Primary Examiner* — Richard Crispino
*Assistant Examiner* — Phu Nguyen
(74) *Attorney, Agent, or Firm* — Da Vinci's Notebook, LLC

(57) ABSTRACT

The present invention is directed to a hookah hose, hookah system, and process for cooling hookah smoke in a hookah. The hookah hose includes a shank, a conduit, a mouthpiece, and a reservoir bearing a coolant cartridge. The shank permits the hookah hose to connect to a stem of a hookah generally or the hookah system of the present invention. The use of coolant cartridges permits a user to manipulate both wet smoke temperature and velocity.

13 Claims, 7 Drawing Sheets

HOOKAH HOSE, HOOKAH SYSTEM

FIELD OF THE INVENTION

The present invention relates to the field of wetted smoking and more specifically to the field of hookahs.

BACKGROUND

Of the many proud traditions of Ottoman culture, few have achieved the world-wide fame of hookah smoking. Once confined to the Middle East and Near East regions, the hookah's notoriety was invigorated by Napoleon's invasion of Egypt and the stream of curious Westerners which followed thereafter. Painters, such as Eugene Delacroix and Jean-Leon Gerome, when depicting Oriental styles typically included a hookah as a symbol of the depicted culture. The hookah was elevated from a regional curiosity to a universal symbol of sophistication.

The hookah, which has maintained a constant popularity in the Middle East, presently enjoys in American culture a unique, niched function. Hookah smoking combines community and relaxation into a single event. Rarely does one witness a group smokers crowded about a single cigarette, cigar, or pipe. Though hookahs are often designed with a single smoke outlet; the presence of multiple hoses, each capable of simultaneous use, emanating from a single smoking instrument is unique to the hookah. Multiple hose hookahs form the centerpieces of hookah clubs in which hookah smokers gather to unwind and converse with other community members. A hookah combines fashion, art, and function into a single device.

A basic hookah includes a base, a stem, at least one hose with a mouthpiece, and a bowl. The hookah bowl holds the hookah tobacco, frequently "massell." Massell is a mixture of tobacco, molasses, and often a flavor or fruit extract. The molasses and fruit extract add a substantial amount of moisture to the massell that is missing in conventional tobacco. This added moisture makes massell more sensitive to the elements relative to conventional tobacco; prolonged exposure to air evaporates much of the moisture of massell and reduces its flavor. When properly protected, massell allows a smoker a more recreational, flavored smoke than the tobacco of cigars, cigarettes, pipes, and the like. An experienced hookah smoker will know to loosely distribute massell into a pile within the hookah bowl to allow heat to evenly circulate through the pile.

The heat that ignites the massell derives from coals positioned above the hookah bowl. The coals and massell preferably never contact one to the other. A common method of placing coals proximate to the massell involves spreading a foil upon the top of a hookah bowl, punching holes in the foil, and then placing the coals onto the foil. The heat from the lighted coals travels through the holes in the foil to ignite portions of the massell. Particulates from the massell travel in the smoke created by the ignition down through the hookah bowl into the hookah pipe.

The hookah stem is the body of a hookah and is usually fabricated from brass, tin, or stainless steel. The stem transports the massell smoke from the bowl to the hookah base, which is a cavern containing water. The base of the hookah is typically fabricated of glass or plastic and tends to be the most expressive portion of the hookah, ranging from translucent to wildly-colored. Within the cavern of the hookah base, the massell smoke is cooled by the water within. The cooled massell smoke then returns to the stem, though not through the same entrance by which the massell smoke enters the base. From the stem, the massell smoke travels through the hose and out of the mouthpiece.

There are presently two prominent versions of hookah structures: the Lebanese style and the Egyptian style. Although the aficionado will explain that there are many differences between the two styles, the practical layman would quickly note the obvious difference: the connection point between the stem and the hookah bowl. The Egyptian style hookah pipe tapers upward into what is generally referred to as a male connection. The Egyptian style hookah bowl includes a female connection which receives the pipe's male connection. In the Lebanese style hookah the bowl has the tapered male connection and the pipe has the female connection to accept the Lebanese style hookah bowl. In both styles, to allow a more airtight connection a collar is generally added to fit around the male connection.

Wet smoke from a hookah has had its internal temperature manipulated by the liquid of the base. However, the liquid of the base may not supply a sufficient ability to control the internal temperature and further control may be desired. Furthermore, the use of a room temperature liquid prevents the wetted smoke from achieving a temperature less than that of room temperature. A user may further desire to alter the ability to control wetted smoke temperature without disturbing a base, or may desire to alter the fluid flow characteristics of a hookah singly or among multiple parties of a group. Therefore there is a need for a hose, hookah system, and process that permits controlled, effective manipulation of wetted smoke pressure and temperature in the presence of a uniform barrier filter layer.

SUMMARY

The present invention is directed to a hookah hose, hookah system, and process for cooling hookah smoke in a hookah. The hookah hose includes a shank, a conduit, a mouthpiece, and a reservoir bearing a coolant cartridge. The shank permits the hookah hose to connect to a stem of a hookah. The shank begins with a shank aperture that accepts wetted smoke from the stem of a hookah and passes the wetted smoke within the hose conduit. The conduit is the flexible body of the hose that conducts wetted smoke to the mouthpiece and the mouthpiece aperture. Positioned on the hose, between the shank aperture and the mouthpiece aperture is the reservoir. The reservoir includes a cavity that may be exposed for the placement of the coolant cartridge. The coolant cartridge includes a membrane that bears an artificial cold source, e.g. a phase transitional fluid. The cartridge may have internal and peripheral wet smoke channels to contact cool wetted smoke as it passes through the reservoir.

The hookah system includes the hookah hose as part of an advantageous hookah system. The hookah system includes the hookah hose, a hookah base, and a removable hookah stem. The hookah stem sits upon the hookah base and includes a dry smoke conduit that releases dry smoke to a substantial depth within the base. The hookah stem includes a wet smoke duct within the hookah stem that is positioned over the base and shunts wetted smoke to the shank aperture of the hose. The hookah system may accept multiple hoses.

The process for cooling hookah smoke includes vertically passing dry smoke through a dry smoke conduit. The dry smoke is released directly into fluid within a sealed hookah base. A user draws with oral suction wetted smoke through the hose through the reservoir and interior cavity with the coolant cartridge. The coolant cartridge cools on contact the wetted smoke.

Therefore, it an aspect of the present invention to provide superior cooling for wetted smoke smoking device.

Therefore, it is an aspect of the present invention to provide a hookah hose capable of independently cooling smoke irrespective of the hookah to which it is attached.

It is a further aspect of the present invention to provide a hookah hose adapted to bear a replaceable cooling device capable of replacement during use of the hookah to which it is attached.

It is a further aspect of the present invention to provide a hookah hose adapted to cool wetted smoke with minimal mess within the hose.

It is a further aspect of the present invention to provide a hookah system and process capable of filtering and wetting dry smoke and further cooling the resulting wetted smoke.

It is a further aspect of the present invention to provide a hookah system, hose, and process capable of effective cooling and filtering without generating substantial internal back pressure at the point of cooling.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
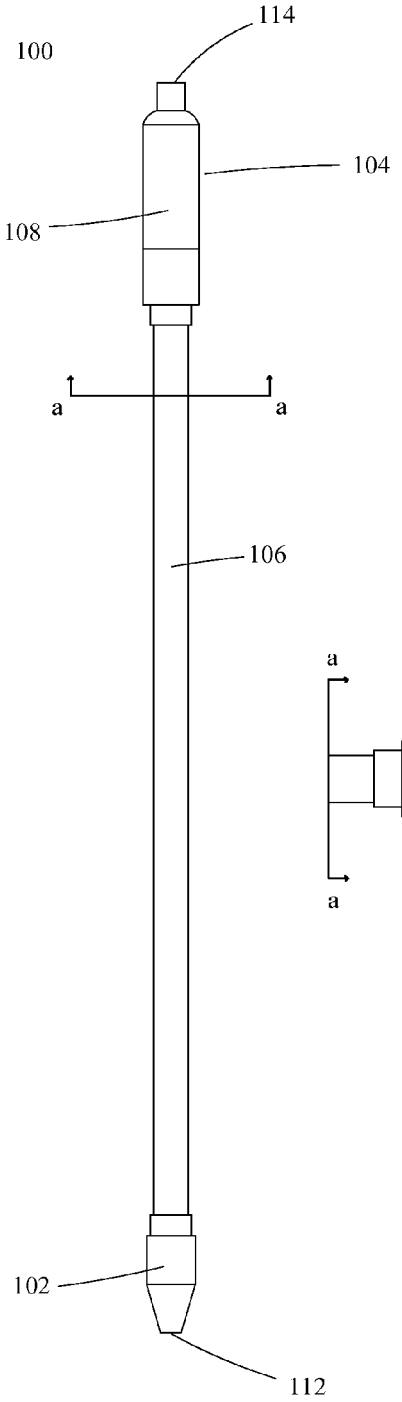
FIG. 1 is an orthographic view of an embodiment of the hose of the present invention.
Figure 2:
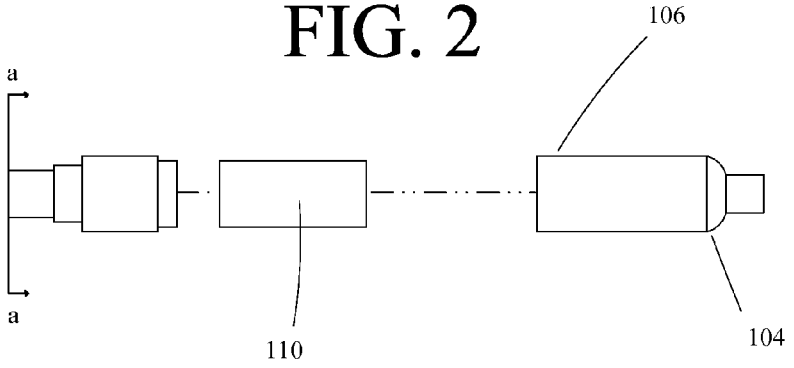
FIG. 2 is a partial, exploded view of the hose of FIG. 1 along cutting lines a-a.

Referring first to FIGS. 1 and 2, a basic embodiment of the hookah hose 100 is shown. (Overview the main elements). The hookah hose 100 includes a shank 102, a conduit 106, a mouthpiece 104, and a reservoir 108 bearing a coolant cartridge 110. The shank 102 permits the hookah hose 100 to connect to a stem of a hookah. The shank 102 begins with a shank aperture 112 that accepts wetted smoke from the stem of a hookah and passes the wetted smoke within the hose conduit 106. The shank 102 need not have any particular sizing or dimensions. It is preferred that the shank have variable outer walls, e.g. frustoconical, that permit the shank to form a sealed interference fit with a hookah stem. The hookah hose 100 may be utilized with any existing hookah and the shank may be formed to fit a particular hookah or dimensioned to permit universal attachment. The shank is preferably a rigid, inflexible material that may include metals, plastic, or other hard material.

The shank 102 is preferably integrally affixed to the conduit 106. The conduit 106 is a long flexible component to allow a user to use a hookah in multiple positions adjacent to the hookah. Throughout the conduit 106 is a wet smoke passage that begins in the shank 102 with the shank aperture 112. The conduit 106 is longitudinally connected to the mouthpiece 104, a rigid component with a mouthpiece aperture 114. The mouthpiece aperture 114 is an opening in the mouthpiece that permits a user to apply oral suction to urge wetted smoke from the shank opening 112, into the wet smoke passage of the shank 102, through the wet smoke passage of the conduit 106, into the wet smoke passage of the mouthpiece 104, though the mouthpiece aperture 114, and to the user. The shank 102, conduit 106, and mouthpiece 104 contribute to form a single wet smoke passage placing the shank, conduit, and mouthpiece in fluid communication with each other component of the hose.

Figure 6:
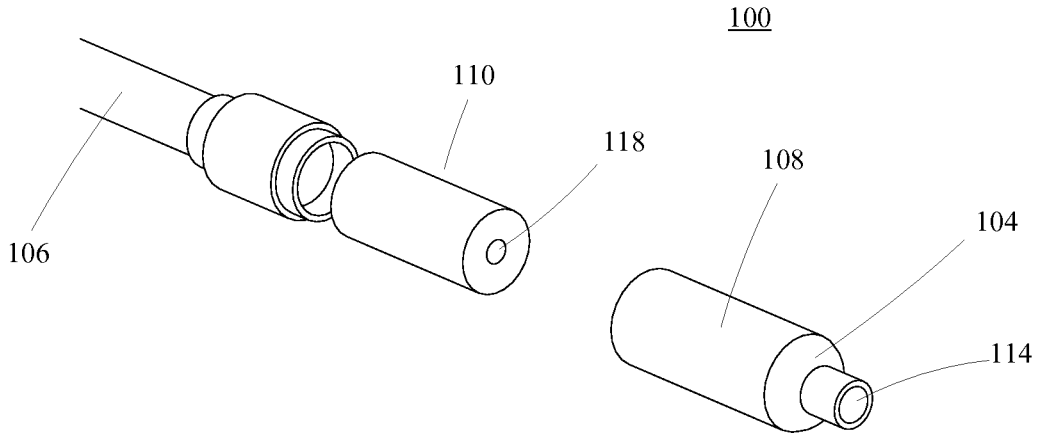
FIG. 6 is a partial, perspective view of an embodiment of the hose of the present invention.
Figure 7:
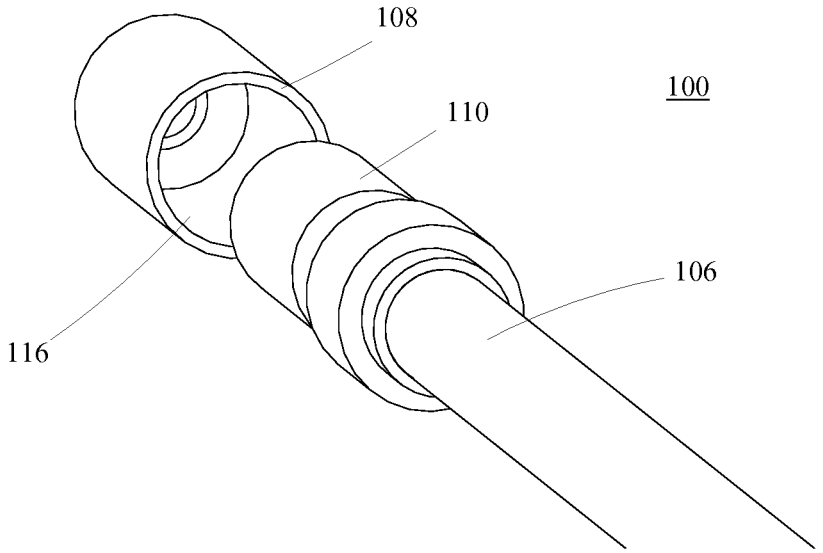
FIG. 7 is a partial, perspective view of an embodiment of the hose of the present invention.

Turning to FIGS. 6 and 7, integrated upon the hose, between the shank aperture and the mouthpiece aperture 114 is the reservoir 108. The reservoir 108 includes a cavity 116 that may be exposed for the placement of the coolant cartridge 110. The preferred reservoir 108 is a mouthpiece reservoir affixed directly adjacent to said mouthpiece 104 such that the reservoir and the mouthpiece ostensibly form a unitary component. The preferred reservoir is configured to include an inflexible construction to form a segmentable shell. By segment, it is meant that a portion of the reservoir separates from another portion of the shell to the extent necessary to access the cavity 110 for removal/placement of a coolant cartridge 110. The cavity 108 may include any dimensions adapted to contain the coolant cartridge; the preferred dimensions include that of a cylinder. The segmented reservoir may include threading to permit reservoir portions to be selectively removable and securely maintained. The reservoir is positioned contiguous to the wet smoke passage and in fluid communication with the shank, conduit, and mouthpiece.

Figure 3:
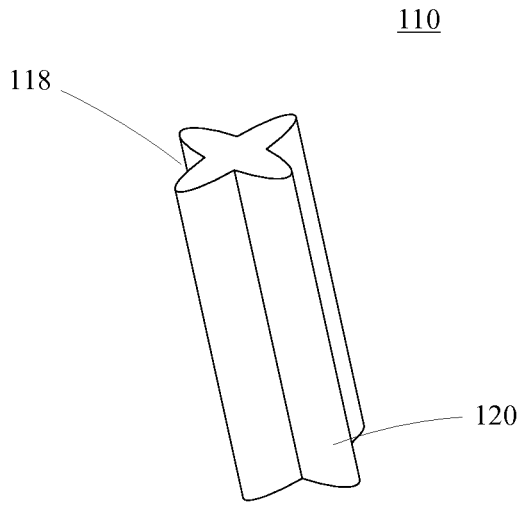
FIG. 3 is a perspective view of an embodiment of the coolant cartridge.
Figure 4:
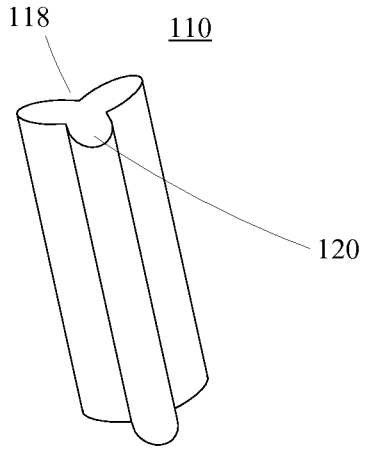
FIG. 4 is a perspective view of an embodiment of the coolant cartridge.
Figure 5:
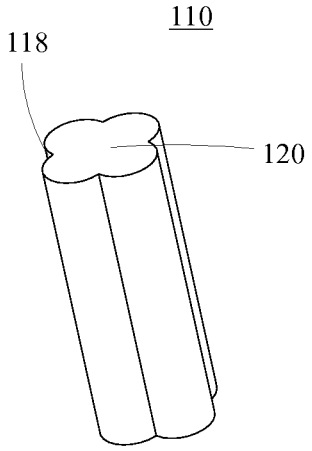
FIG. 5 is a perspective view of an embodiment of the coolant cartridge.

Turning to FIGS. 3-5, the coolant cartridge 110 includes a membrane 120 with an artificial cold source, preferably phase transitional fluid, therein. By phase transitional fluid, it is meant a substance that is naturally a liquid at comfortable room temperatures, e.g. approximately 50-100 degrees Fahrenheit, but undergoes a phase change to a solid at temperatures less than comfortable room temperature environments. By artificial cold source, it is meant a substance adapted to achieve a coolant temperature due to ancillary interactions with the coolant cartridge catalyzed or supplied by external factors. Examples of artificial cold sources and external factors include: freezing or cooling a membrane bearing water or a water derivative (e.g., diluted isopropyl alcohol), breaking a separation layer within the membrane that bears separated urea and ammonium chloride that intermingle upon breaking of the separation layer, separated ammonium nitrate and a starch material acting as a gelling agent in one zone and water in another zone, and the like.

As a gelling agent, inorganic compounds such as metal oxides, metal alkoxides, or alkali metal salts of metal oxides can be used. These include zinc oxide, tin oxide, titanium oxide, zirconium oxide, and silicates and aluminates in combination with solvents such as water and alcohols. Useful organic gelling agents include organic compounds such as carbohydrates including starch; polyacrylamide; polyols such as pentaerythritol; or proteinaceous materials such as dried gelatin. These agents can form gels in combination with solvents such as water, acetone, alcohols, dimethoxytetraglycol. As a multiple use artificial cold source may include any compound adapted for maintenance of internal, chilled temperature to a greater degree than simple frozen water; a preferred artificial cold source may include a combination of water, gel food grade guar gum, and sodium chloride, or water and a cellulose ether. The artificial cold source need not undergo a phase change, although a phase change liquid is preferred as the phase change may be indicative of a substantial increase in internal temperature of the artificial cold source. Any plastic or vinyl material, or other suitable material dependent upon the manufacturer's desire for rigidity or flexibility, may be used in the construction of the membrane.

The cartridge may have internal and peripheral wet smoke channels 118 to contact cool wetted smoke as it passes through the reservoir. By wet smoke channel 118, it is meant a conduit within or upon the cartridge by which wetted smoke may pass longitudinally through or along the cartridge. As the cartridge is adapted to be positioned with the cavity of a reservoir and the reservoir is in fluid communication with the shank-mouthpiece-conduit network, there must be some void that permits wetted smoke to pass along the cartridge to the mouthpiece aperture. The passage along the cartridge is in a manner that permits a substantial amount of wetted smoke to contact the cartridge membrane and cool the wetted smoke. With the channel is entirely bounded by the cartridge, as in FIG. 6, then the channel is considered an internal channel; when the channel is only partially bounded by the cartridge and is further bounded by the inner sidewall of the reservoir, then the channel is considered a peripheral channel. Multiple, peripheral channels are preferred in the cartridge of the present invention as multiple channels permit a greater surface area of the cartridge to contact the wetted smoke during passage.

Furthermore, the cartridge may include a flavoring agent either within the membrane 120, or the cartridge may be composed of the flavoring agent. Due to the pressure factors within a hookah system, it is preferred that the cartridge bearing the flavoring agent include dimensions similar to cooling cartridges of the present invention.

Figure 8:
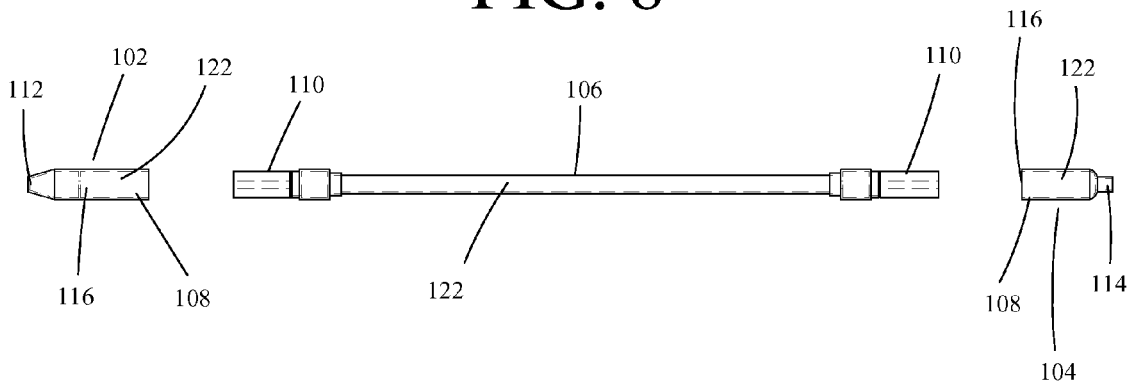
FIG. 8 is a revealed, orthographic view of an embodiment of the hose of the present invention.

As depicted in FIG. 8, the present invention may include multiple reservoirs 108 with multiple cavities 116 for multiple cartridges 110. The cartridges 110 may include similar or differing dimensions. The reservoirs may be positioned at any position along the hose in fluid communication with the wet smoke passage 122. It is preferred any auxiliary reservoir include a shank reservoir positioned adjacent to the shank 102 such that the shank 102 and reservoir ostensibly form an integrated component. The reservoir may include any reservoir attributes stated herein.

Figure 9A:
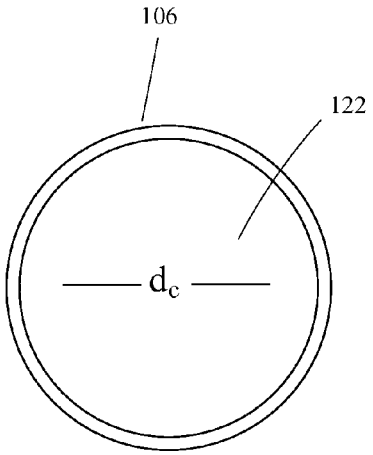
FIG. 9A is a cross-sectional view of an embodiment of the hose of the present invention.
Figure 9B:
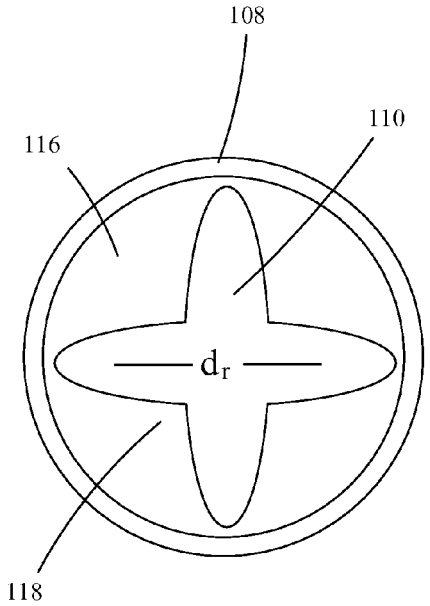
FIG. 9B is a cross-sectional view of an embodiment of the hose of the present invention.
Figure 10:
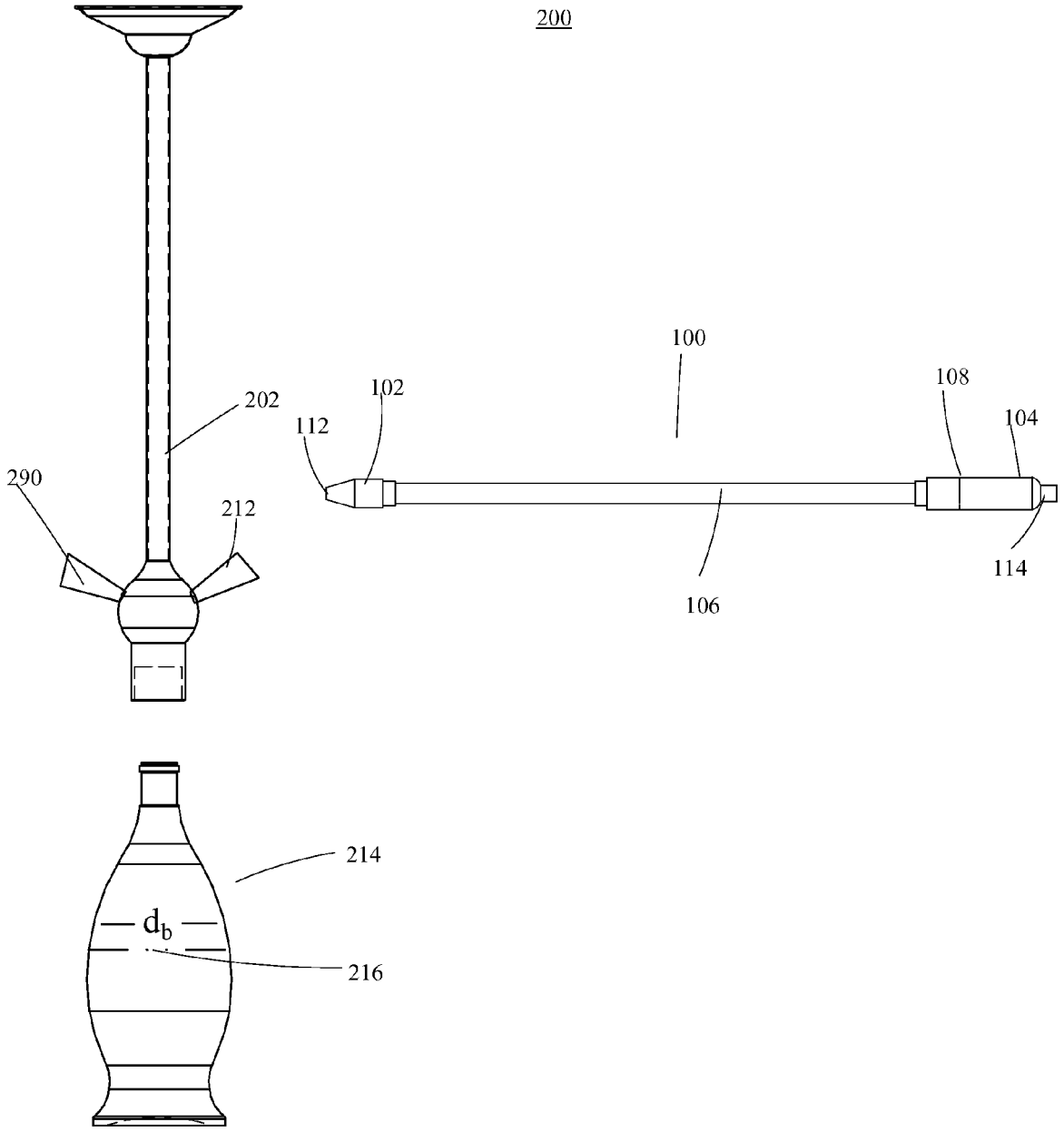
FIG. 10 is an orthographic view of the hookah system of the present invention.
Figure 11A:
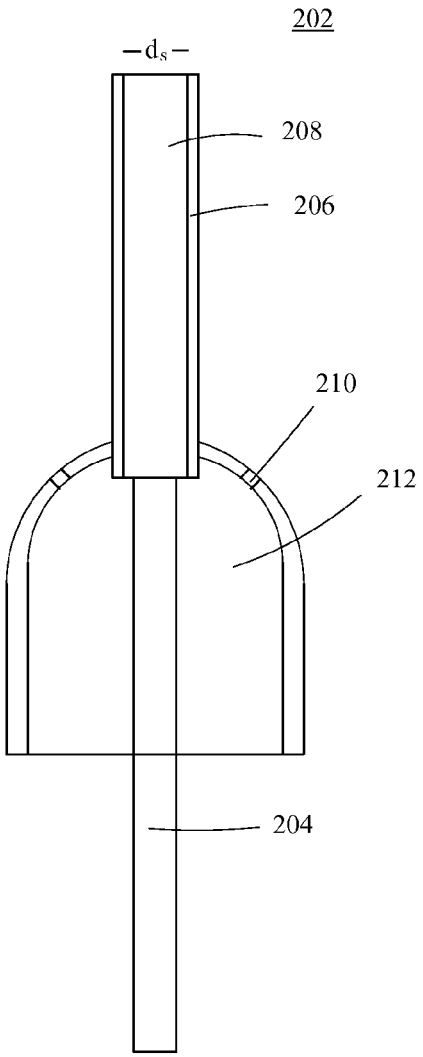
FIGS. 11A and B are exposed views of hookah stems of the present invention.
Figure 11B:
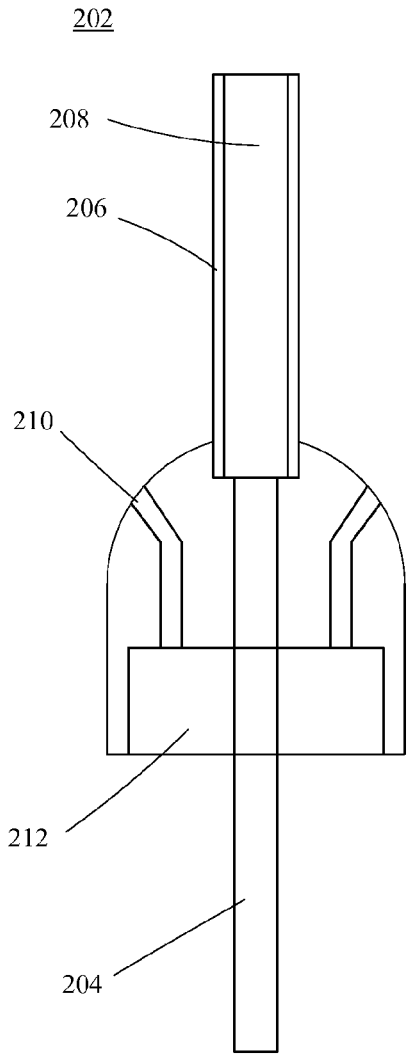
Figure 12:
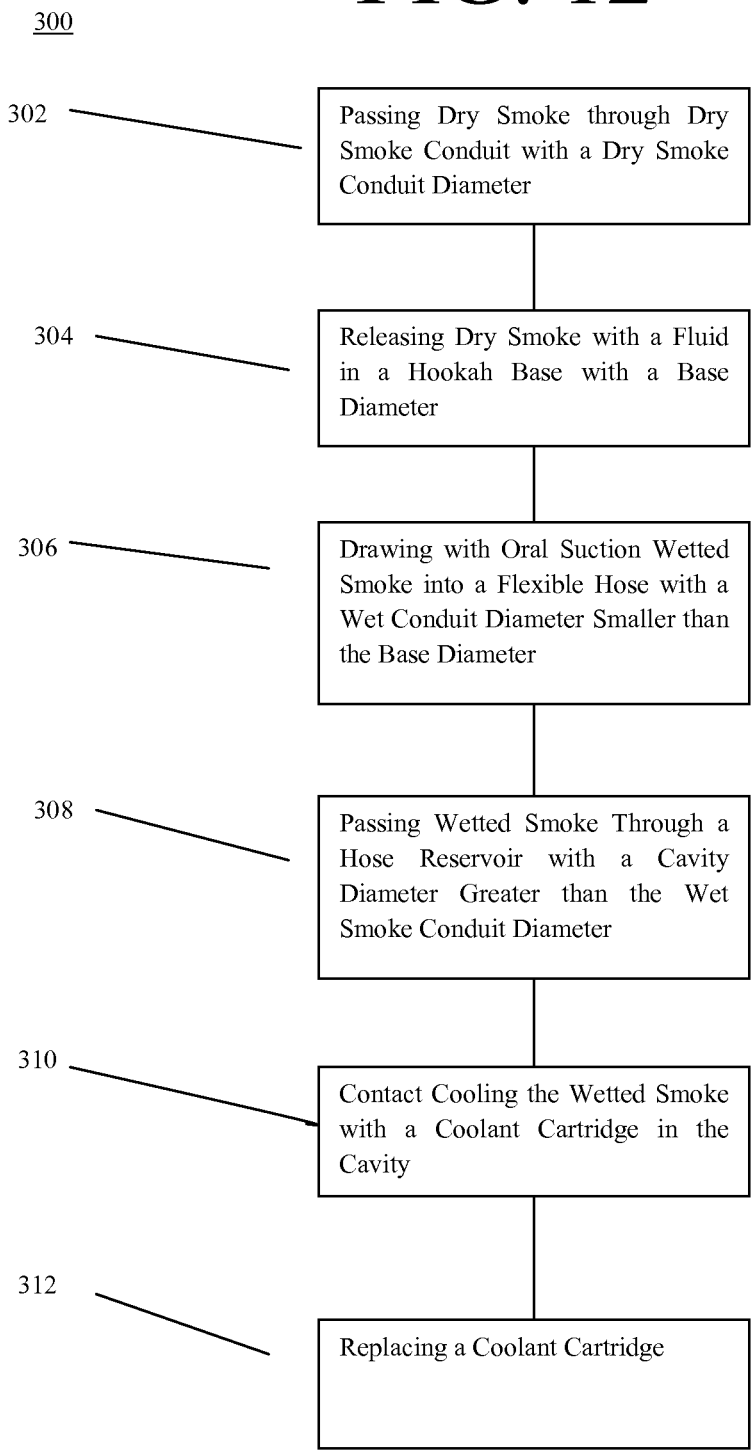
FIG. 12 is a view of the process of the present invention.

As shown in FIGS. 9A-9B, the reservoir 108 of the present invention includes a reservoir diameter $d_r$. By diameter, it is meant a measurement from a first side of the interior of the reservoir to a second, opposing side of the interior of the reservoir. The cartridge is preferably sized to form an interference fit, slip fit, or close fit with the reservoir. Closing positioning the proximities of the cartridge to the inner wall of the reservoir permits the travel path of wetted smoke to be more closely predicted and regulated. The conduit 106 also includes a diameter $d_c$ defined by a measurement from a first side of the interior of the conduit to a second, opposing side of the interior of the conduit. The reservoir diameter is preferably sized to be substantially larger than the conduit diameter. By sizing the reservoir diameter to be larger than the conduit diameter, it permits a greater amount of cartridge surface area to be utilized with a minimum of back pressure and other fluid dynamics negatives resulting from detrimental cross section restrictions. It is more preferred that an aggregation of the wet smoke channels 118 of the coolant cartridge 110 results in an aggregated cartridge channel cross-section area at least dimensionally comparable to, and more preferably greater than, a cross-section area of the wet smoke passage. In other words, providing a cross section area within the reservoir—notwithstanding the presence of the cartridge—approximately equal to, or greater than, that of the cross section of the conduit 106 permits wetted smoke to continue passage without detrimental pressure effects within the hose. The present invention, however, may be practiced with reservoirs having a cross section area sized approximately equal to, or smaller, than a cross section of a conduit. It is preferred that the diameter of the reservoir be greater than that of the diameter of the mouthpiece aperture and shank aperture.

As depicted in FIGS. 10, 11A, 11B, and 12 the hookah system 200 of the present invention includes a stem 202, a base 214, and hose 100. The hose may include any of the attributes discussed within the present disclosure. The base 214 and stem 202 may include generally commercially available hookah bases and stems; however, certain characteristics described within this disclosure permit advantageous synergistic advantages. The base 214 may include any hookah vessel adapted to contain a room temperature liquid 214. The base typically includes a sidewall that expands downward, which is of significance in light of the fluid dynamics advantages of the present invention. The liquid 214 is filled within the base to a degree significant to cool and filter dry smoke from the stem 202. Dry smoke travels down a dry smoke conduit 208 of the stem 202, with a stem diameter $d_s$, from a bowl attached thereto (not shown). The stem of the present invention includes any component or series of components adapted to vertically pass dry hookah smoke from a hookah bowl to a hookah base. The stem may include a unitary construction, or include an intermediate tube 206 affixed to a down tube 204. The stem penetrates the base 214 suitable to permit the dry smoke to be passed 302 through the stem and released 304 into a substantial amount liquid 216 of the base 214. By substantial amount of liquid, it is meant an amount of liquid suitable to provide significant or customary cooling of a dry hookah smoke. Typical liquid amounts include approximately 100.0 mL to 1.0 L, depending upon the size and configuration of the base. The liquid forms a uniform barrier to the passage of dry smoke in the sealed environment of a stem/base/hose configuration except through disruption of the barrier. A uniform liquid filter barrier is differentiated from a solid perforated filter layer, e.g., charcoal filters or fibrous filters, which permits passage of dry smoke without disruption of the structure of the layer.

Liquid is a preferred filter layer as it is disposable and includes a greater capacity to absorb the temperature of the dry smoke. Disadvantages of a uniform liquid barrier include its negative effects on a user's force required to draw smoke. Embodiments of the present invention require a uniform liquid barrier, and rather than seek means of eliminating the uniform liquid barrier, seek to mitigate its negative effects in further cooling of smoke. Means for mitigating the negative effects of the uniform liquid barrier include downstream adjustment of internal configurations.

As the smoke is released from the stem into the base, the smoke becomes wetted smoke and rises into a wet smoke duct 212, which may include either a cavern or discrete voids within the stem. The smoke may rise of its own volition or be drawn 306 via the oral suction of a user having a hose in fluid communication with the base. The base includes a base diameter $d_b$ as measured from opposing inner sidewalls of the base just above the waterline. The wet smoke duct 212 leads to the wet smoke outlet 210, which permits a hookah hose to be attached thereto. When the hookah hose 100 of the present invention is attached to the wet smoke outlet 210, the wetted smoke is conducted to the reservoir 108. It is preferred that the reservoir 108 of the hookah hose 100 include a preferred sizing as indicated within the present disclosure. Furthermore, it is preferred that the wet smoke outlet 210 be sized similar to the shank aperture 122 to prevent back pressure at the shank aperture and wet smoke outlet juncture. It is further preferred that the shank aperture, wet smoke outlet, and wet smoke passage include comparable cross section sizing.

The reservoir bears the coolant cartridge of the present invention and cools 310 by contact the wetted smoke passing through the reservoir. It is significant that smoke has passed through two layers of cooling and a layer of filtration with the use of only two media, the liquid barrier and the coolant cartridge. Depending upon the configuration of the internal voids of the hookah system, including the preferred sizings of the present invention, the two layers of filtration/manipulation convey no substantial negative pressure effects beyond those of the single uniform liquid layer. Further advantages of the present system, hose, and process are apparent in that depleted coolant cartridges, i.e. those that have an internal temperature approximately equal to or greater than that of room temperature, may be replaced while one or more users continue to use the hookah system. Furthermore, the use of coolant cartridges specifically adapted to alter fluid pressure within the hookah to suit the user may be achieved through the current process and system. For example, users desiring greater smoke force may utilize coolant cartridges with aggregated smoke channels having a cross section less than, particularly substantially less than, the wet smoke passage of the hookah conduit, shank aperture, wet smoke outlet, or other internal passage.

For example, users desiring less smoke force may utilize coolant cartridges with aggregated smoke channels having a cross section greater than, particularly substantially greater than, the wet smoke passage of the hookah conduit, shank aperture, wet smoke outlet, or other internal passage. The velocity of resulting smoke will be related to the internal constrictions of the hookah; by placing constriction elements within the hose, the constriction may be suited to the user of a particular hose rather than an agreed upon pressure of a hookah or water pipe. The velocity of dry and wet smoke is altered significantly in the present invention due to the substantially varying diameters of the dry smoke conduit 208, base 214, wet smoke outlet 210, shank opening 212, wet smoke conduit 122, wet smoke passages 118, and the mouthpiece aperture 114. The use of the present invention in relation to the pressure increase of the dry smoke conduit to the base, from the base to the wet smoke outlet/shank opening may be greatly ameliorated by the configuration of the wet smoke passages of the coolant cartridge in the cavity—either for greater or lessor pressure. The use of an autoseal mechanism 290 contributes to internal pressure stability by permitting a user to "purge" the stem of overpressure. The autoseal mechanism may include a sealing mechanism such as that disclosed in United States Patent Published Patent Application No. 2006/0272657, which is hereby incorporated by reference.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A hookah hose for the transport of cooled, wetted smoke, said hose comprising:

an inflexible shank having a shank aperture and defining an interior wet smoke passage in fluid communication with said shank aperture;

a flexible conduit, affixed to said shank, further defining said interior wet smoke passage, wherein said wet smoke passage includes a wet smoke passage diameter, an inflexible mouthpiece having a mouthpiece aperture, affixed to said flexible conduit in fluid communication with said flexible conduit;

a mouthpiece reservoir, affixed directly adjacent to said mouthpiece, with an inflexible, segmentable shell defining an interior cavity, with a cavity diameter, in fluid communication with said wet smoke passage and said cavity diameter is greater than said wet smoke passage diameter and a diameter of said shank aperture; and at least one coolant cartridge, dimensioned to be positioned within said cavity, with a membrane sealingly bearing an artificial cold source, and said cartridge dimensioned to include at least one wet smoke channel.

2. The hookah hose of claim 1 wherein coolant cartridge includes multiple, peripheral wet smoke channels.

3. The hookah hose of claim 1 wherein an aggregation of said wet smoke channels results in an aggregated channel cross-section area at least dimensionally comparable to a cross-section area of said wet smoke passage.

4. The hookah hose of claim 3 wherein said aggregated channel cross-section area is greater than said wet smoke passage cross-section area.

5. The hookah hose of claim 1 further comprising a shank reservoir, affixed directly adjacent to said shank, with an inflexible, segmentable shell defining an interior cavity, with a cavity diameter, in fluid communication with said wet smoke passage; and said coolant cartridge.

6. The hookah hose of claim 5 wherein said coolant cartridge within said shank reservoir and said coolant cartridge within said mouthpiece reservoir include peripheral wet smoke channels.

7. The hookah hose of claim 5 wherein an aggregation of said wet smoke channels of said coolant cartridge within said shank reservoir results in an aggregated shank channel cross-section area: at least dimensionally comparable to a cross-section area of said wet smoke passage, and at least dimensionally comparable to an aggregation of said wet smoke channels of said coolant cartridge within said mouthpiece reservoir.

8. A hookah system for the transport of cooled, wetted smoke, said system comprising:

a hookah base, dimensioned to contain an interior fluid medium, a removable hookah stem, capable of sealed fit upon said hookah base, comprising:

a wet smoke duct within said hookah stem positioned over said base and terminating in a wet smoke outlet; and a dry smoke conduit dimensioned to release dry smoke to a substantial depth within said hookah base;

a hookah hose comprising:

an inflexible shank having a shank aperture, adapted to releasable affix to said hookah stem, and defining an interior wet smoke passage in fluid communication with said shank aperture and said wet smoke outlet;

a flexible conduit, affixed to said shank, further defining said interior wet smoke passage, wherein said wet smoke passage includes a wet smoke passage diameter;

an inflexible mouthpiece having a mouthpiece aperture, affixed to said flexible conduit in fluid communication with said flexible conduit;

a mouthpiece reservoir, affixed directly adjacent to said mouthpiece, with an inflexible, segmentable shell defining an interior cavity, with a cavity diameter, in fluid communication with said wet smoke passage and said cavity diameter is greater than said wet smoke passage diameter and a diameter of said shank aperture; and at least one coolant cartridge, dimensioned to be positioned within said cavity, with a membrane sealingly bearing an artificial cold source, and said cartridge dimensioned to include at least one wet smoke channel.

9. The hookah system of claim 8 wherein said hookah stem includes at least two wet smoke ducts that include a first wet smoke duct and a second wet smoke duct terminating in a first wet smoke outlet and a second wet smoke outlet, respectively; and at least two hookah hoses.

10. The hookah system of claim 9, wherein said at least two wet smoke ducts include an automatically sealing first wet smoke duct and an automatically sealing second wet duct.

11. The hookah system of claim 8 wherein coolant cartridge includes multiple, peripheral wet smoke channels.

12. The hookah system of claim 8 wherein an aggregation of said wet smoke channels results in an aggregated channel cross-section area at least dimensionally comparable to a cross-section area of said wet smoke passage.

13. The hookah system of claim 12 wherein said aggregated channel cross-section area is greater than said wet smoke passage cross-section area.

* * * * *